US006705143B2

(12) United States Patent
Liu

(10) Patent No.: US 6,705,143 B2
(45) Date of Patent: Mar. 16, 2004

(54) METHOD OF MANUFACTURING LOADING PLANE BORDER FRAME TUBES FOR CHAIRS

(76) Inventor: Lausan Chung-Hsin Liu, No. 243, Chien-Kuo Rd., Hsin-Tien City, Taipei Hsien (TW)

( * ) Notice: Subject to any disclaimer, the term of this patent is extended or adjusted under 35 U.S.C. 154(b) by 43 days.

(21) Appl. No.: 09/917,832

(22) Filed: Jul. 31, 2001

(65) Prior Publication Data

US 2003/0024289 A1 Feb. 6, 2003

(51) Int. Cl.[7] ..... B21D 39/02

(52) U.S. Cl. ..... 72/52; 72/181; 72/368; 29/897; 228/147

(58) Field of Search ..... 72/52, 181, 367.1, 72/368, 370.26, 370.24, 370.23, 51, 178, 177; 29/890.36, 897; 219/612, 607, 102, 614, 78.16; 228/147

(56) References Cited

U.S. PATENT DOCUMENTS 408,729 A * 8/1889 Limont ..... 72/368
1,141,066 A * 5/1915 Lloyd ..... 72/368
1,420,042 A * 6/1922 Kritz ..... 72/137
2,127,618 A * 8/1938 Riemenschneider ..... 72/178
2,153,811 A * 4/1939 Montgomery ..... 72/164
2,277,473 A * 3/1942 Anderson ..... 228/147
2,346,990 A * 4/1944 Oftedal ..... 72/161
2,687,465 A * 8/1954 Crawford ..... 219/612
2,769,887 A * 11/1956 Crawford ..... 219/608
2,948,324 A * 8/1960 Penrose ..... 72/178
3,230,336 A * 1/1966 Gueugnier ..... 219/612
3,242,301 A * 3/1966 Osborn ..... 219/612
3,509,753 A * 5/1970 Orth ..... 72/177
3,698,224 A * 10/1972 Saytes ..... 72/178
4,238,550 A * 12/1980 Burgess et al. ..... 428/586
5,104,026 A * 4/1992 Sturrus et al. ..... 72/368
5,163,225 A * 11/1992 Goleby ..... 29/897.35
5,875,668 A * 3/1999 Kobayashi et al. ..... 72/181
5,934,544 A * 8/1999 Lee et al. ..... 72/181

* cited by examiner

*Primary Examiner*—Daniel C. Crane
(74) *Attorney, Agent, or Firm*—Bacon & Thomas

(57) ABSTRACT

A method of manufacturing loading plane border frame tubes for chairs utilizes continuous roll-forming processes to roll a base material to form loading plane border frame tubes for use on chairs. The processes include: transport a steel sheet to a roller leveler for flattening; then roll the steel sheet through a first roller calender, a second roller calender, a third roller calender, and a fourth roller calender to form a semi-finished tube; send the semi-finished tube to a high frequency generator for welding and soldering at high temperature; trim the semi-finished tube in a trimming machine; and roll the semi-finished tube through a fifth roller calender to form a finished tube of a selected shape for making border frames of loading planes of the chairs.

3 Claims, 10 Drawing Sheets

METHOD OF MANUFACTURING LOADING PLANE BORDER FRAME TUBES FOR CHAIRS

BACKGROUND OF THE INVENTION

The present invention relates to a method of manufacturing loading plane border frame tubes for chairs and particularly a method that utilizes continuous roll-forming processes to roll a base material to form loading plane border frame tubes for use on chairs.

Many leisured chairs now available on the market have small sizes and light weights, and are easy to carry and store. Their prices are also relatively inexpensive. Hence they are widely accepted by consumers. Whereas they still have problems when in use.

Most leisured chairs have a loading section to support human body. The loading section generally has a loading border frame formed by a round steel tube and a seat pad made of a selected fabric or leather. The fabric or leather is stitched at the rims to form a coupling section. During assembly, the steel tube is directly inserted into the coupling section. Or the coupling section of the fabric or leather may be connected to the border frame by springs. When used for supporting people for a period of time, the stitching of the fabrics or leather could be frayed and ruptured, or the springs connecting the fabrics (or leather) and loading border frame could have elastic fatigue, or the round steel tube will result in deformation. It could become risky to users when using.

The loading border frame of conventional leisured chairs may also be made of light wood to couple with the fabric or leather coupling section. Or the fabric or leather may be stitched directly to the wooden border frame by means of staple guns. When used for supporting people for a period of time, the stitching of the fabrics or leather could be frayed and ruptured. The stapled portions also tend to rupture, or the wooden frame broken. It also incurs safety concerns to users.

SUMMARY OF THE INVENTION

The primary object of the invention is to resolve the foregoing disadvantages. The invention aims to provide a continuous roll-forming processes to roll a base material to form loading plane border frame tubes for use in chairs. When in use, the rims of the loading plane (such as loading planes made by weaving or braiding fabrics, leather, plastic sheets) are fastened to an insert element which may be directly wedged into the frame tube so that the loading plane won't be ruptured when supporting the weight of people.

Another object of the invention is to provide formed tubes that are simple and easy to assemble to save processes and time.

A further object of the invention is to provide formed tubes with selected cross sections to complement the supporting power of the loading plane so that deformation or rupture is less likely incur to the loading plane To attain the foregoing objects, the method for manufacturing the tubes of the invention includes to flatten and smooth steel sheets through a roller leveler, then the steel sheets are formed to semi-finished tubes by roll-forming processes through a first, a second, a third and a fourth roller calender. The semi-finished tubes then are conveyed to a high frequency generator for welding and soldering at high temperature, then are delivered to a trimming machine for finishing, and finally are transported to a fifth roller calender to proceed final roll-forming to become finished tubes for use in loading planes of chairs.

The foregoing, as well as additional objects, features and advantages of the invention will be more readily apparent from the following detailed description, which proceeds with reference to the accompanying drawings.

DESCRIPTION OF THE PREFERRED EMBODIMENTS

The method of manufacturing loading plane border frame tubes for chairs according to the invention includes a front stage process 10, a middle stage process 30 and a rear stage process 40 for roll-forming a metal sheet 20 to tubes for use as loading plane border frame on chairs.

Figure 1A:
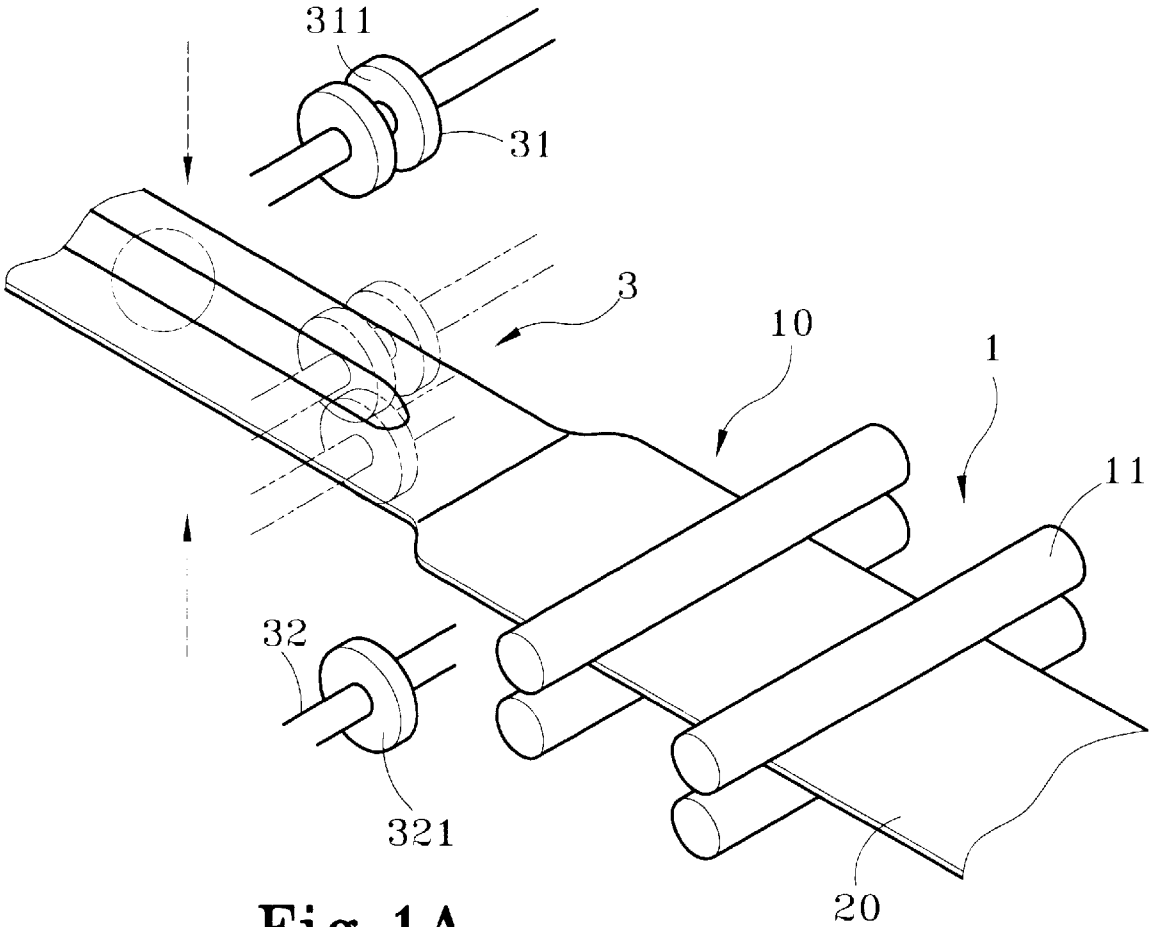
FIG. 1A is a schematic view of a first manufacturing process for making a first tube embodiment of the invention.

Referring to FIG. 1A, in the front stage process 10 a metal sheet 20 is prepared and setup as the base material for the tube. The steel sheet 20 is transported to a roller leveler 1 which has a plurality of rollers 11 to flatten and smooth the surfaces of the steel sheet 20 to ensure the quality of the finished tubes.

Figure 1B:
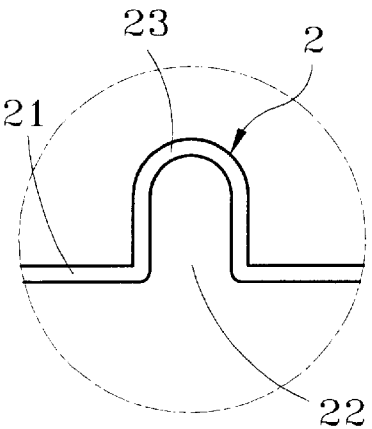
FIG. 1B is a first schematic end view of a semi-finished first tube embodiment.

After the steel sheet 20 is flattened by the roller leveler 1, it is conveyed to a first roller calender 3 and is rolled between a first upper roller 31 and a first lower roller 32. The first upper roller 31 and the first lower roller 32 have respectively a first concave surface 311 and a first convex surface 321 to roll and form the steel sheet 20 to become a semi-finished steel sheet as shown in FIG. 1B. The cross section of the semi-finished steel sheet 20 has a bulged section 2 and two flat sections 21 at two sides.

Figure 2A:
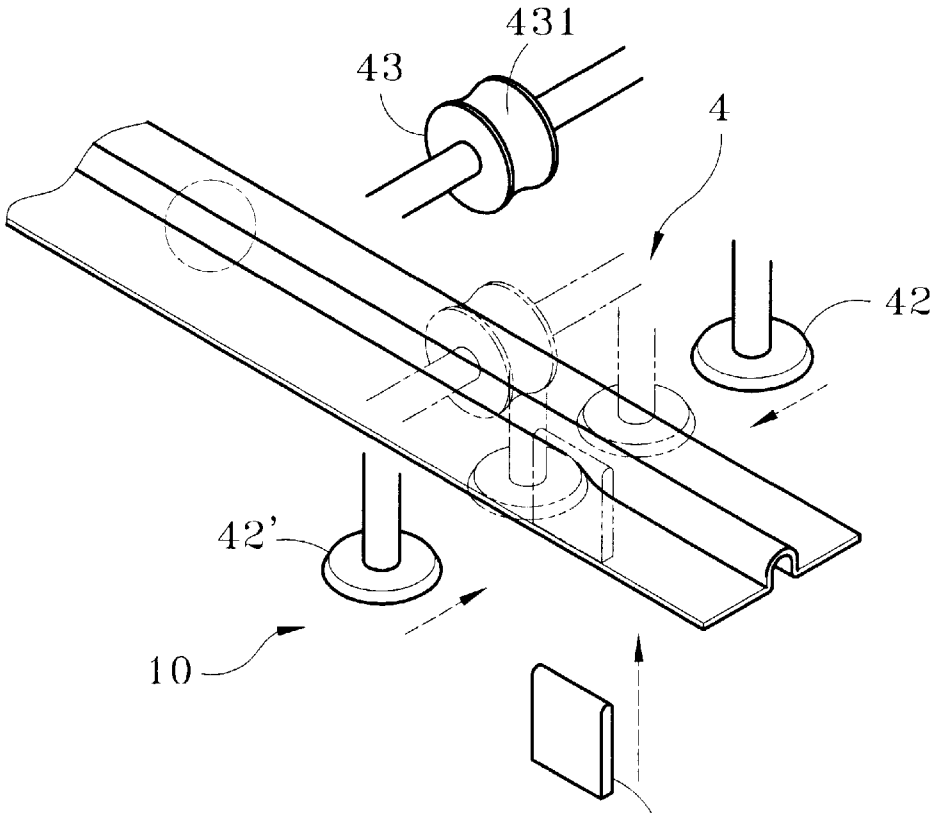
FIG. 2A is a schematic view of a second manufacturing process for making a first tube embodiment of the invention.
Figure 2B:
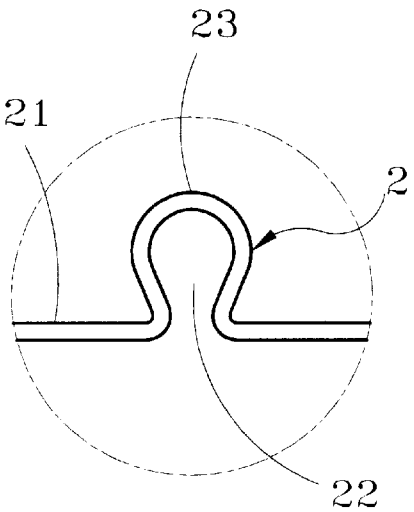
FIG. 2B is a second schematic end view of a semi-finished first tube embodiment.

After completing the rolling process set forth above, the semi-finished steel sheet 20 is transported to a second roller calender 4 (as shown in FIG. 2A). There is a second guide plate 41 inserting into the bulged section 2, and two second flank rollers 42, 42' are provided at two sides of the second guide plate 41 to roll the bulged section 2 of the steel sheet 20 from two sides on the junctures of the bulged section 2 and the flat sections 21 against the second guide plate 41. The resulting semi-finished steel sheet 20 will have a narrower opening 22. There is a second forming roller 43 located above the second guide plate 41. The second forming roller 43 has a second concave surface 431 rolling on an arched surface 23 formed on the top of the bulged section 2. The resulting semi-finished steel sheet 20 has a cross section as shown in FIG. 2B.

Figure 3:
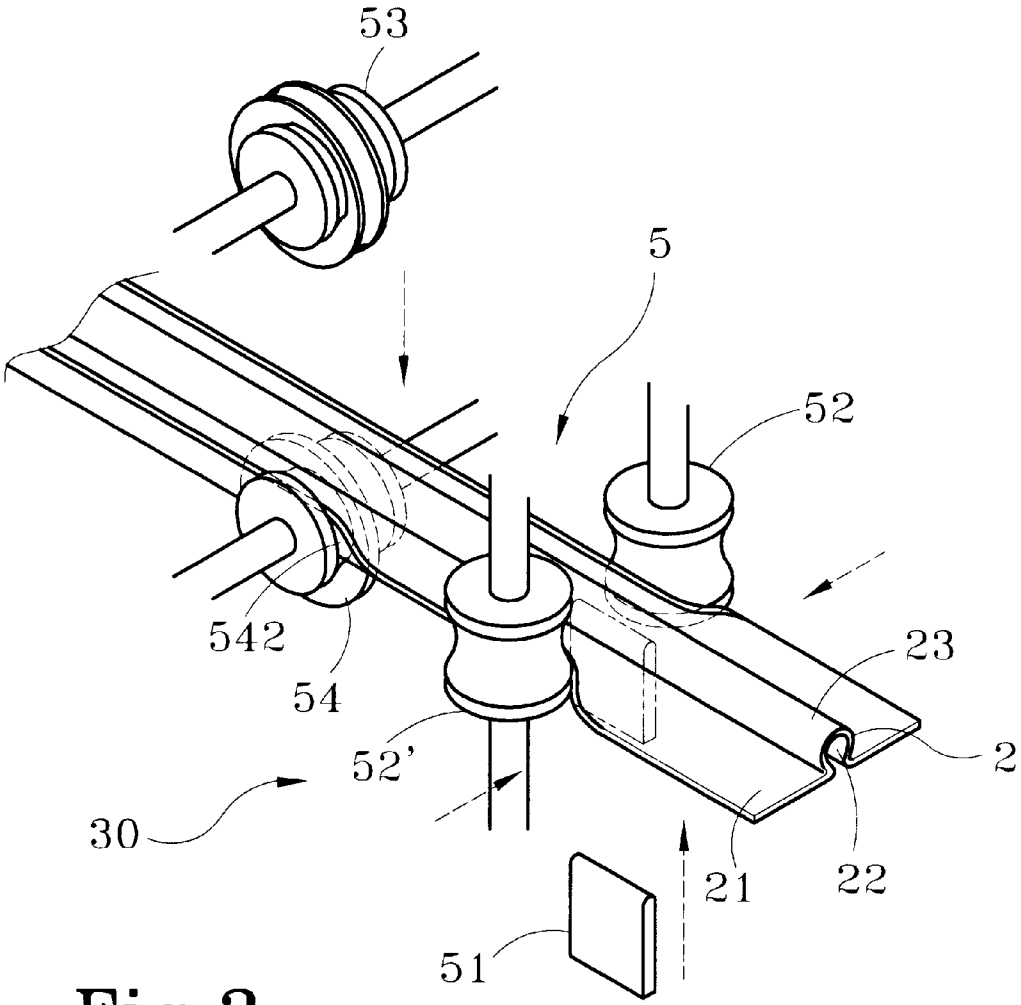
FIG. 3 is a schematic view of a third manufacturing process for making a first tube embodiment of the invention.

After completing the front stage process 10 set forth above, the semi-finished steel sheet 20 is transported to a third roller calender 5 of the middle stage process 30 as shown in FIG. 3. The third roller calender 5 has a third guide plate 51 which may be inserted into the bulged section 2, and two third flank rollers 52, 52' located at two sides of the third guide plate 51 for rolling the flat sections 21 at two sides of the bulged section 2 to deform the flat sections such that they become curving upwards to the center of the bulged section 2. There are a third upper forming roller 53 and a third lower forming roller 54 which have respectively a third concave surface 531 and a third convex surface 541 to roll the bulged section 2. The third lower roller 54 further has two concave surfaces 542 located at two sides of the third convex surface 541 to deform the flat sections 21 of the semi-finished steel sheet 20 and makes them curving further towards the center of the bulged section 2.

Figure 4A:
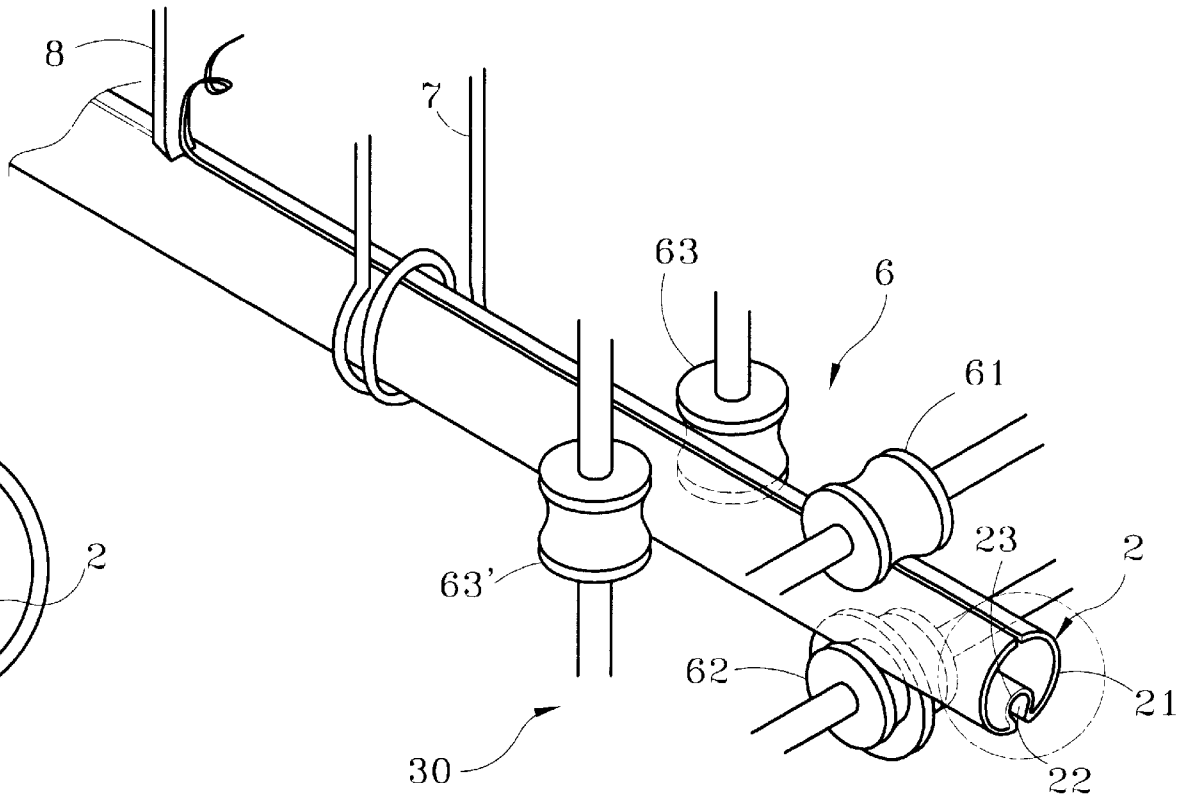
FIG. 4A is a schematic view of a fourth manufacturing process for making a first tube of the invention.
Figure 4B:
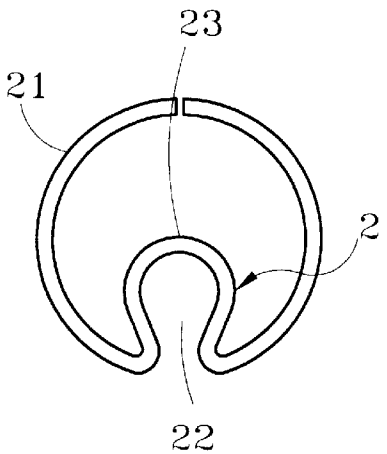
FIG. 4B is a third schematic end view of a semi-finished first tube of the invention.

After finishing roll-forming in the third roller calender 5, the semi-finished steel sheet 20 is conveyed to a fourth roller calender 6 (as shown in FIG. 4A). There are a fourth upper forming roller 61 and a fourth lower forming roller 62, and two sets of fourth flank rollers 63, 63' to roll and further deform the semi-finished steel sheet 20 at two ends (to make the two free ends adjacent to each other) above the bulged section 2 (as shown in FIG. 4B). After finishing roll-forming in the fourth roller calender 6, the semi-finished steel sheet 20 is welded and soldered by a high frequency generator 7, and then is trimmed by a trimming machine 8.

Figure 5:
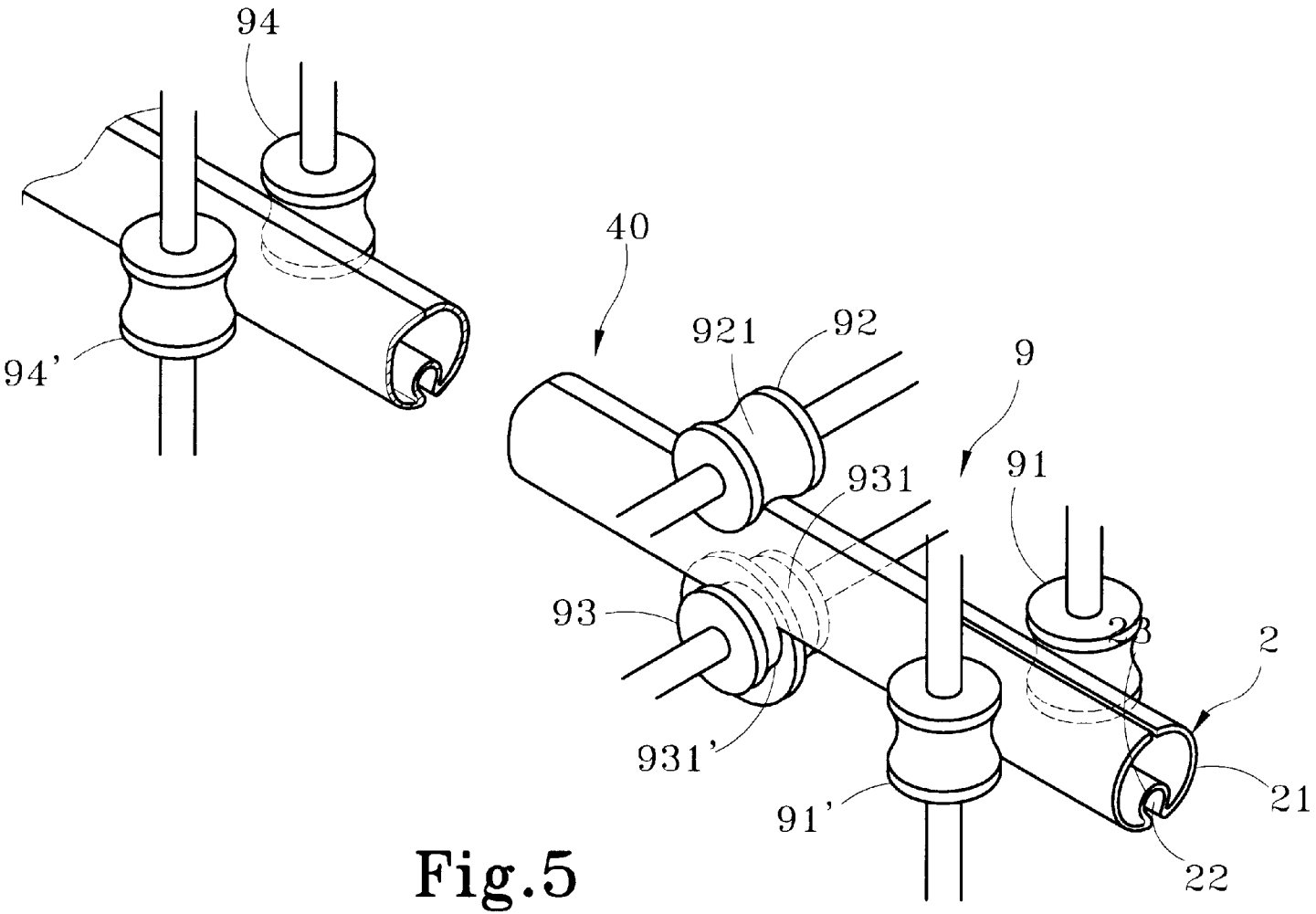
FIG. 5 is a schematic view of a fourth manufacturing process for making a first tube embodiment of the invention.

After completing the middle stage process 30 set forth above, the semi-finished steel sheet 20 is transported to a fifth roller calender 9 of the rear stage process 40. The fifth roller calender 9 has two feeding rollers 91, 91' (as shown in FIG. 5) to move and carry the semi-finished steel sheet 20. There is a fifth upper forming roller 92 which has a fifth concave surface 921 to roll and form the two ends of the flat sections 21 to become an arched or flat surface. There is also a fifth lower forming roller 93 which has two concave surfaces 931, 931' to roll and form the junctures of the flat sections 21 and the bulged section 2 to become arched or flat surfaces. Then there are transport rollers 94, 94' located at the rear end of the fifth roller calender 9 to move and discharge the formed tubes to complete the manufacturing of the border frame tubes of the loading plane for chairs.

In the foregoing processes, different forms of tubes can be made by changing the surface profiles of the roller calenders. The following depicts another tube embodiment of the invention.

Figure 6A:
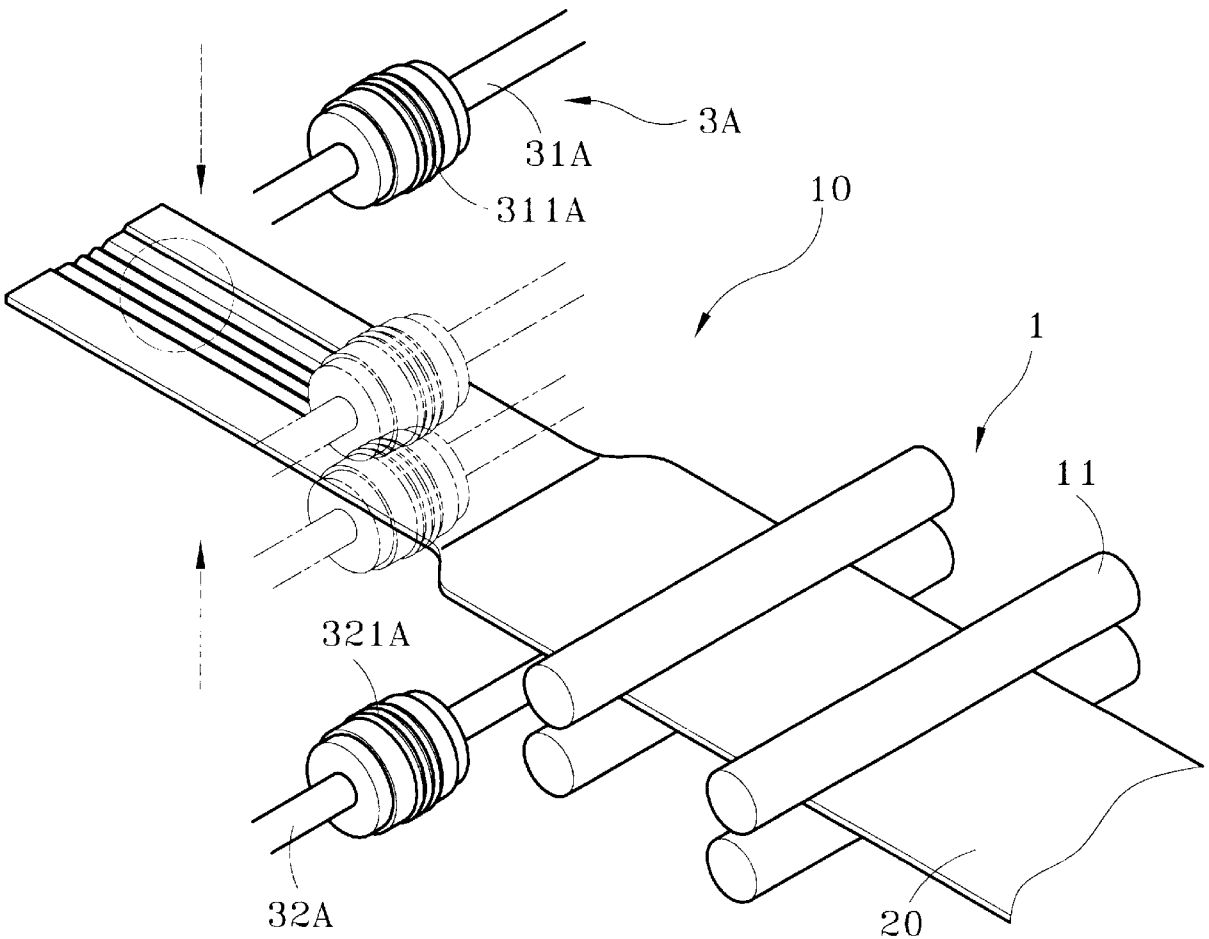
FIG. 6A is a schematic view of a first manufacturing process for making a second tube embodiment of the invention.

Referring to FIG. 6A, in the front stage process 10 a metal sheet 20 is setup as the base material for the tube. The steel sheet 20 is transported to the roller leveler 1 which has a plurality of rollers 11 to flatten and smooth the surfaces of the steel sheet 20 to ensure the quality of the finished tubes.

Figure 6B:
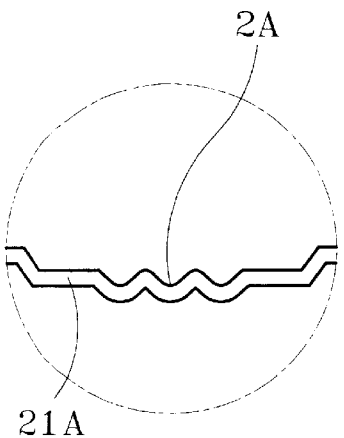
FIG. 6B is a first schematic end view of a semi-finished second tube embodiment.

After the steel sheet 20 is flattened by the roller leveler 1, it is conveyed to a first roller calender 3A and is rolled between a first upper roller 31A and a first lower roller 32A. The first upper roller 31A and the first lower roller 32A have respectively a first upper corrugated surface 311A and a first lower corrugated surface 321A to roll and form the steel sheet 20 to become a semi-finished steel sheet as shown in FIG. 6B. The cross section of the semi-finished steel sheet 20 has a corrugated section 2A and two flat sections 21A at two sides.

Figure 7A:
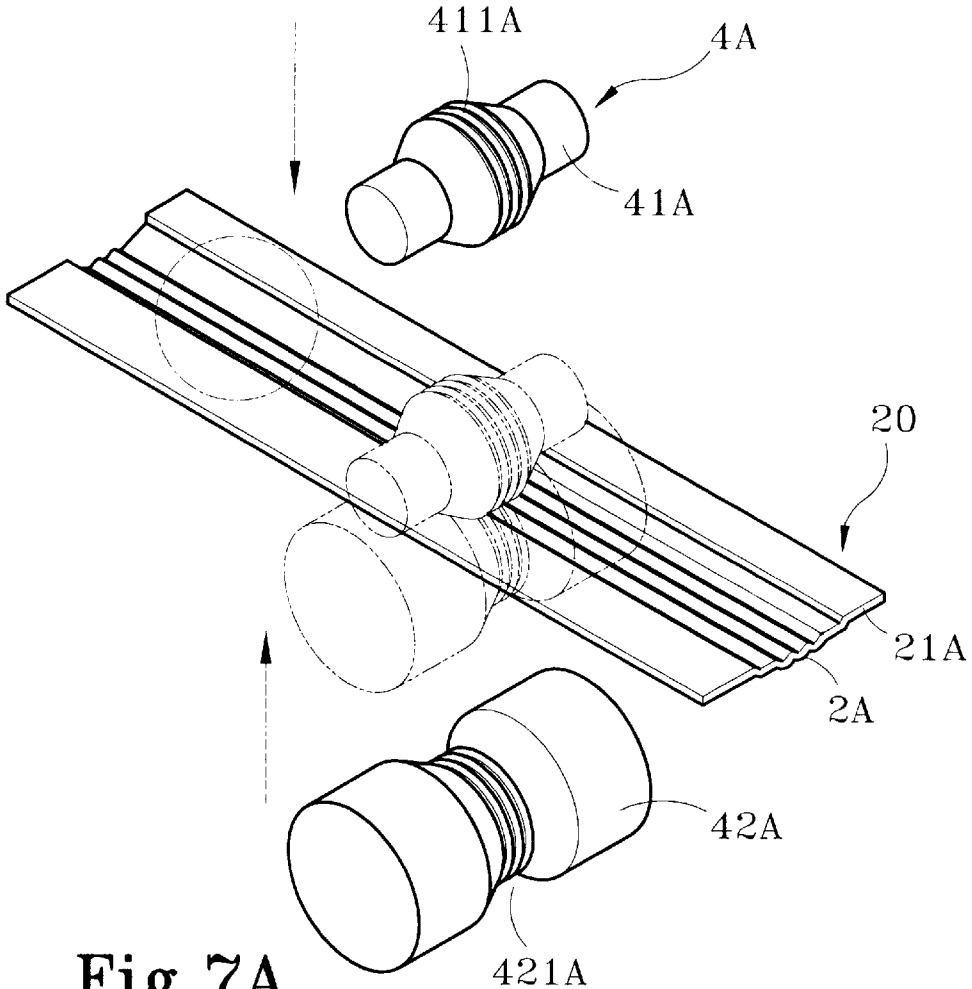
FIG. 7A is a schematic view of a second manufacturing process for making a second tube of the invention.
Figure 7B:
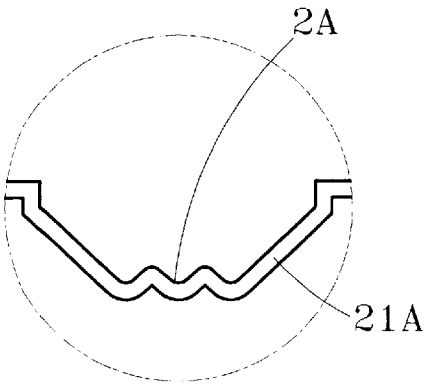
FIG. 7B is a second schematic end view of a semi-finished second tube of the invention.

After completing the rolling process set forth above, the semi-finished steel sheet 20 is transported to a second roller calender 4A (as shown in FIG. 7A). The second roller calender 4A has a second upper forming roller 41A and a second lower forming roller 42A which have respectively a second upper corrugated surface 411A and a second lower corrugated surface 421A rolling on the semi-finished steel sheet 20 to make the two flat sections 21A tilted upwards (as shown in FIG. 7B).

Figure 8:
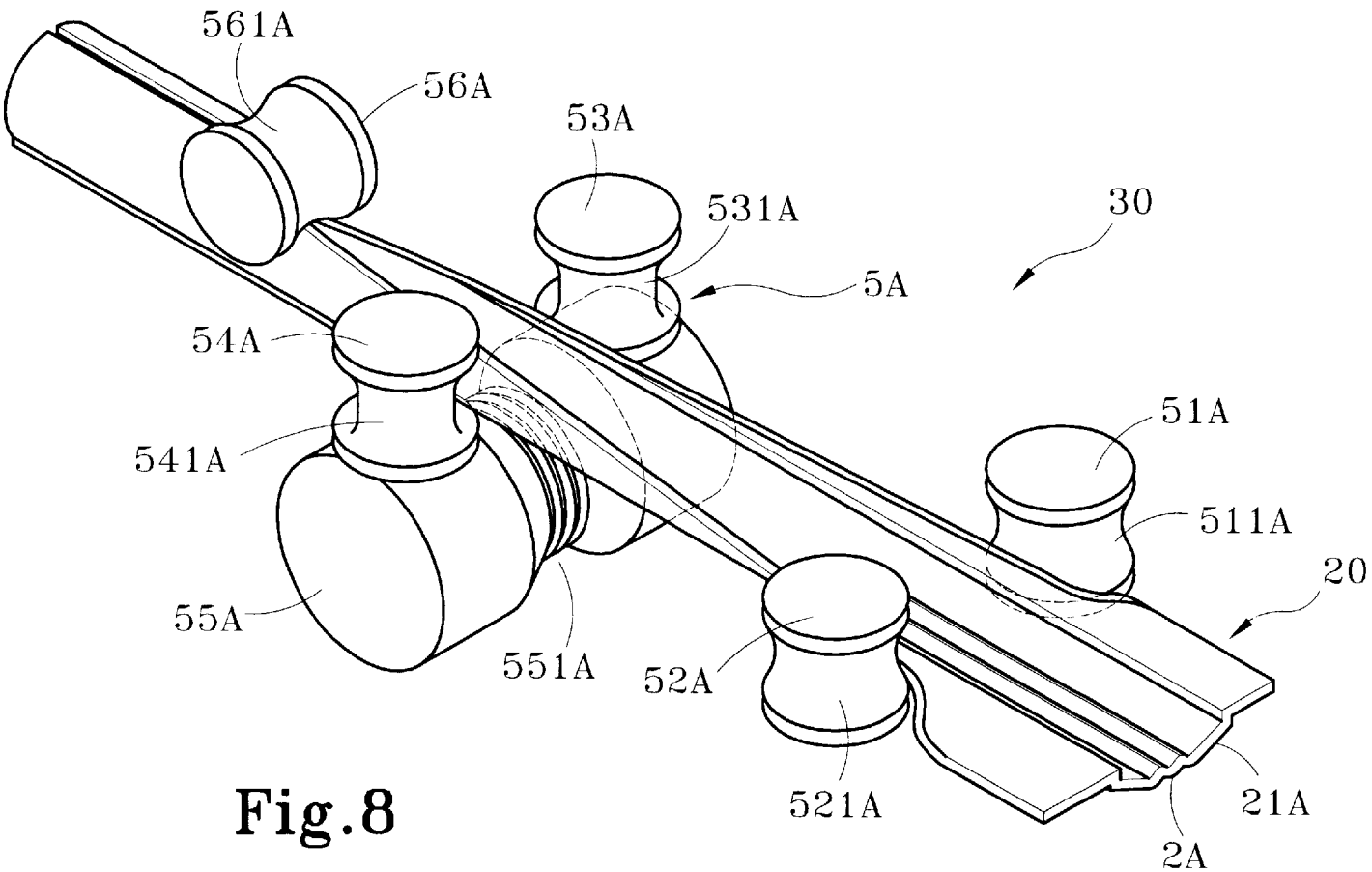
FIG. 8 is a schematic view of a third manufacturing process for making a second tube embodiment of the invention.

After completing the front stage process 10 set forth above, the semi-finished steel sheet 20 is transported to a third roller calender 5A of the middle stage process 30 as shown in FIG. 8. The third roller calender 5A has two sets of first flank rollers 51A, 52A and two sets of second flank rollers 51A, 52A located behind the first flank rollers 51A, 52A, and a third lower forming roller 55A located below the second flank rollers 53A, 54A. The rollers 51A, 52A, 53A, 54A and 55A have respectively a concave surface 511A, 521A, 531A, 541A and 551A to roll and form the two flat sections 21A to tilt upwards in a curvy fashion. There is a third upper forming roller 56A which has a concave surface 561A to roll and form the two flat sections 21A until two ends of the two flat sections 21 adjacent to each other in the center.

Figure 9A:
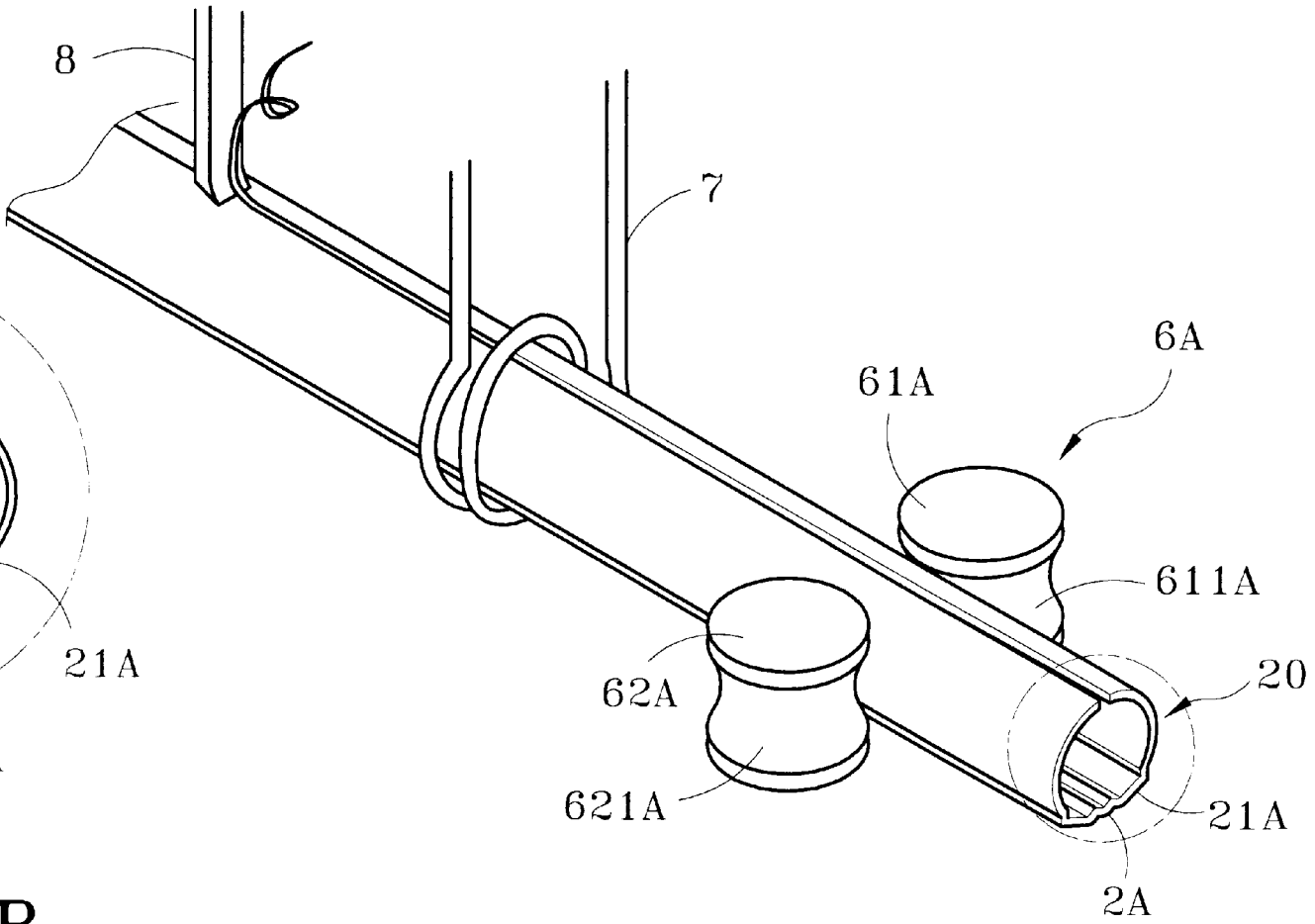
FIG. 9A is a schematic view of a fourth manufacturing process for making a second tube embodiment of the invention.
Figure 9B:
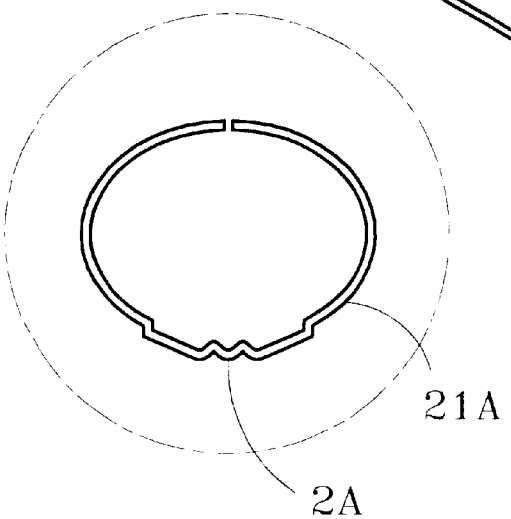
FIG. 9B is a third schematic end view of a semi-finished second tube embodiment.

After finishing roll-forming in the third roller calender 5, the semi-finished steel sheet 20 is conveyed to a fourth roller calender 6A (as shown in FIG. 9A). The fourth roller calender 6A has two sets of fourth flank rollers 61A, 62A which have respectively a fourth concave surface 611A and 621A to roll and further deform the two flat sections 21 of the semi-finished steel sheet 20 to become as curvy as desired (as shown in FIG. 9B).

After finishing roll-forming in the fourth roller calender 6A, the two ends of the two flat sections 21 are welded and soldered by a high frequency generator 7, and then the semi-finished steel sheet 20 is trimmed by a trimming machine 8.

Figures 10A, 10B:
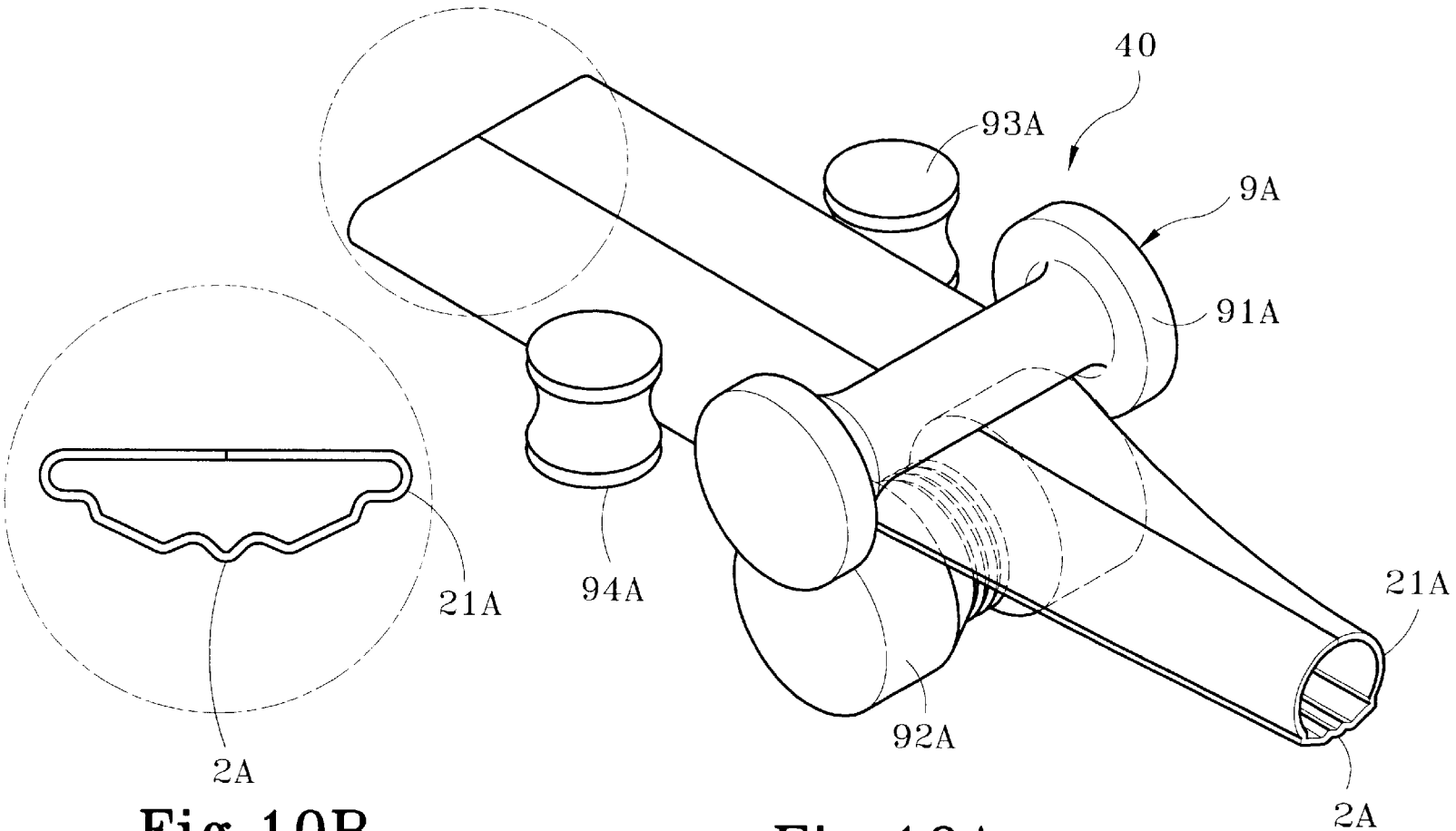
FIG. 10A is a schematic view of a fifth manufacturing process for making a second tube embodiment of the invention.
FIG. 10B is a schematic end view of a finished second tube embodiment.

After completing the middle stage process 30 set forth above, the semi-finished steel sheet 20 is transported to a fifth roller calender 9A of the rear stage process 40. The fifth roller calender 9A has a fifth upper forming roller 91A and a fifth lower forming roller 92A to roll and flatten the semi-finished steel sheet 20 to a desired shape. Then there are two sets of fifth flank rollers 93A and 94A to roll and form the side walls of the semi-finished steel sheet 20 to a curved shape desired. Thus complete the production of the tubes for border frame of loading plane for chairs (as shown in FIG. 10B).

The tubes manufactured by the processes set forth above can be used to make loading plane border frames of chairs. When in use, first, measure the size of the loading plane, then cut the tube based on the border frame required for supporting the loading plane. The cut tube is then formed and shaped to become the border frame. The loading plane may be directly inserted into the tube to form the loading plane of the chair.

Furthermore, after the tube is formed, the cross section of the tube can complement the loading plane to support the weight of people. It is less likely to deform and can effectively prevent the loading plane from rupturing.

What is claimed is:

1. A method for manufacturing a loading plane boarder frame tube for a chair which comprises:

transporting a length of sheet metal continuously through a roller leveler to flatten said strip of sheet metal along the length thereof thereby forming a flat length of sheet metal;

roll forming said flat length of sheet metal through a roller calendar to continuously deform a portion of said flat strip along the length thereof so that said sheet metal includes a deformed portion extending along the length thereof and a flat portion extending along either side of said deformed portion;

continuously roll forming said sheet metal having said deformed portion through a series of roller calendars to bend said flat portion on either side of said deformed portion thereby forming said length of sheet metal into a tubular configuration having two edges of said strip being adjacent to each other, said roller calendars have a surface profile to deform said length of sheet metal into the shape of a tube having corrugations extending along the length thereof; and joining said edges together by welding or soldering.

2. The method of claim 1 wherein said roller calendars have a surface profile to deform said length of sheet metal into the shape of a tube having an invaginated groove along the length thereof.

3. The method of claim 1 wherein said roller leveler includes a plurality of rollers.

* * * * *